United States Patent [19]

Prewarski

[11] 4,351,618

[45] Sep. 28, 1982

[54] SELECTION CONTROLLED PRINT IMPRESSION CONTROL FOR SINGLE ELEMENT IMPACT PRINTERS

[75] Inventor: Mike Prewarski, El Paso, Tex.

[73] Assignee: International Business Machines Corporation, Armonk, N.Y.

[21] Appl. No.: 107,469

[22] Filed: Dec. 26, 1979

[51] Int. Cl.[3] ..... B41J 1/60

[52] U.S. Cl. ..... 400/166; 400/109; 400/161.4; 400/257

[58] Field of Search ..... 400/109, 161.4, 166, 400/257

[56] References Cited

U.S. PATENT DOCUMENTS

| | | | |
|---|---|---|---|
| 3,239,049 | 3/1966 | Voit, Jr. | 400/166 |
| 3,618,736 | 11/1971 | Abell, Jr. et al. | 400/166 |
| 3,892,304 | 7/1975 | Shakib | 400/161.4 X |
| 3,980,169 | 9/1976 | Decker et al. | 400/166 |
| 3,983,984 | 10/1976 | de Kler | 400/161.4 |

OTHER PUBLICATIONS

IBM Technical Disclosure Bulletin, "Print Velocity Control Device", Abell et al., vol. 12, No. 7, Dec. 1969, p. 1032.

*Primary Examiner*—Ernest T. Wright, Jr.
*Attorney, Agent, or Firm*—Laurence R. Letson

[57] ABSTRACT

The impact velocity with which a single element printer prints is determined by the velocity with which the printing element is propelled toward the record sheet. The mechanism disclosed herein is capable of adjusting the velocity with which a print element is projected toward the page such that the impact velocity and, thus the impact forces which are related to the velocity, are controlled and varied to provide a minimum of compromise with respect to printing forces and, thus, print quality. The control of the velocity with which the print element is propelled against the record sheet is accomplished by a cam which rotates with the print element during character selection and has thereon a plurality of rises corresponding to a displacement of a cam follower engaged with a print cam. The print cam is formed to present, in a plurality of different planes perpendicular to its axis, a like plurality of cam profiles and rises. By shifting the print cam follower from one plane to another along the axis of the print cam, the velocity may be selected and controlled. This velocity selection is a direct result of the amount of rise in the cam attached to the shaft which rotates the print element. Thus, print element position, in response to conventional keyboard selection, directly controls the velocity of the print element derived from the rotation of the print cam and therefore, controls impact force.

23 Claims, 8 Drawing Figures

IMAGINARY PLANE

IMPACT SCHEDULE

| | | | | | | | | | | | | | | | | | | | | | | | |
|---|---|---|---|---|---|---|---|---|---|---|---|---|---|---|---|---|---|---|---|---|---|---|---|
| 45 | 45 | 45 | 43 | 41 | 39 | 37 | 35 | 35 | 35 | 32 | 25 | 25 | 32 | 40 | 42 | 44 | 46 | 46 | 46 | 46 | 50 | 50 | 45 |
| 8 | 5 | 6 | 9 | 0 | / | 4 | 3 | 7 | 2 | ; | . | . | : | @ | & | # | $ | ? | ) | ( | ¢ | % | * |
| ⅜ | k | b | d | u | s | r | e | j | i | 2 | , | , | 3 | I | L | E | R | S | U | D | B | K | ⅌ |
| ½ | w | m | h | x | n | o | a | c | ° | + | ' | " | = | ± | C | A | O | N | X | H | M | W | ¼ |
| [ | g | q | p | y | z | t | f | v | j | 1 | — | _ | ! | J | V | F | T | Z | Y | P | Q | G | ] |
| 12 | 11 | 10 | 9 | 8 | 7 | 6 | 5 | 4 | 3 | 2 | 1 | 1 | 2 | 3 | 4 | 5 | 6 | 7 | 8 | 9 | 10 | 11 | 12 |

COLUMN NO.

LOWER CASE

UPPER CASE

FIG. 7

ITALIAN

| | | | | | | | | | | | | | | | | | | | | | | | |
|---|---|---|---|---|---|---|---|---|---|---|---|---|---|---|---|---|---|---|---|---|---|---|---|
| + | ç | è | à | é | ò | ( | ' | ) | " | : | ; | . | / | 2 | 7 | 3 | 4 | 1 | 0 | 9 | 6 | 5 | 8 |
| ù | | | | | | | | | | ì | , | ? | = | | | | | | | | | | % |
| $ | | | | | | | | | < | ò | ^ | ·· | ! | > | | | | | | | | | * |
| ½ | | | | | | | | | | ß | – | _ | ° | | | | | | | | | | £ |

COMMON CHARACTERS

FIG. 6

GERMAN / AUSTRIAN

IMPACT SCHEDULE

IMAGINARY PLANE

| | | | | | | | | | | | | | | | | | | | | | | | |
|---|---|---|---|---|---|---|---|---|---|---|---|---|---|---|---|---|---|---|---|---|---|---|---|
| 45 | 45 | 45 | 43 | 41 | 39 | 37 | 35 | 35 | 35 | 32 | 25 | 25 | 32 | 37 | 42 | 44 | 46 | 46 | 46 | 46 | 50 | 50 | 45 |
| 8 | 5 | 6 | 9 | 0 | β | 4 | 3 | 7 | 2 | ° | . | : | ü | " | / | § | $ | ? | = | ) | ß | % | ( |
| ö | k | b | d | u | s | r | e | 1 | i | 2 | , | ; | 3 | I | L | E | R | S | U | D | B | K | Ö |
| ä | w | m | h | x | n | o | a | c | # | + | ^ | ' | * | ' | C | A | O | N | X | H | M | W | 'A' |
| ü | g | q | p | y | z | t | f | v | j | 1 | – | _ | ! | J | V | F | T | Z | ¥ | P | Q | G | Ü |
| 12 | 11 | 10 | 9 | 8 | 7 | 6 | 5 | 4 | 3 | 2 | 1 | 1 | 2 | 3 | 4 | 5 | 6 | 7 | 8 | 9 | 10 | 11 | 12 |

COLUMN NO.

FIG. 8

FRENCH

| | | | | | | | | | | | | | | | | | | | | | | | |
|---|---|---|---|---|---|---|---|---|---|---|---|---|---|---|---|---|---|---|---|---|---|---|---|
| ! | ( | § | ç | à | ß | ' | " | è | é | : | ; | . | / | 2 | 7 | 3 | 4 | 1 | 0 | 9 | 6 | 5 | 8 |
| ù | | | | | | | | | | 2 | , | ? | 3 | | | | | | | | | | % |
| $ | | | | | | | | | < | + | ^ | ·· | = | > | | | | | | | | | |
| µ | | | | | | | | | | ) | – | _ | ° | | | | | | | | | | £ |

COMMON CHARACTERS

SELECTION CONTROLLED PRINT IMPRESSION CONTROL FOR SINGLE ELEMENT IMPACT PRINTERS

BACKGROUND OF THE INVENTION

This invention relates to the field of impact printing and typewriting with particular emphasis on single element typewriters where velocity control is desired for the purpose of improved quality of the final print.

In the design of typewriters and single element printers, many compromises are necessitated by conflicting mechanical or physical requirements. This is particularly true with respect to the single element impact printers in the area of impact intensity or impact force. For example, the IBM Selectric Typewriter has two impact intensity levels, a high level and low level. The high level impact intensity accommodates letters, numbers and other large area graphic symbols. The low level impact intensity is utilized with the punctuation marks to reduce the forcing of small area symbols, such as period, colon, semicolon, dash, underscore and comma, deeply into the paper causing embossing.

There has been found a general correlation between the area of the character to be printed and the impact force sufficient to obtain substantially complete ink transfer from a ribbon to the printed page. For high quality printing, it is necessary to accomplish substantially complete transfer of all the ink layer from a ribbon which comprises an ink layer and a film plastic substrate. The impact level must also be sufficient to insure the adhesion of the ink to the paper at the time of impact.

At the same time, the impact forces generated between the type element and the platen supporting the record sheet bring about noise. With an increased awareness on noise in the office environment, it is desirable to reduce noise to the minimum. It can be seen that the desire to reduce noise brings about a desire to reduce the impact level or force while at the same time, the desire for quality printing brings about a desire for a higher level force to insure uniform characters on the printed page. These inconsistent desires bring about a need for compromise. The prior art compromises have precisely defined impact levels of a minimal number, i.e. two (2) in the IBM Selectric Typewriter, or a slightly larger number of impact levels with more complex mechanisms for accomplishing the appropriate selection thereof, as found in the IBM Electronic Typewriters 50, 60 and 75 which have three (3) levels of impact intensity.

The more impact intensity levels designed into the typewriter, the more complex the mechanisms necessary to properly generate those impact intensity levels. The more complex machine is more costly and further contributes to mechanical noise. The other prior art approaches of only two intensity levels to prevent the embossing by extremely small characters results in problems such as uneven print color, excessively high printing noise, and inherent incompatability of impact requirements between characters in upper and lower case due to differences in size and incompatability of the character size and impact level where foreign languages are typed on the typewriter by change of the print element, side and overprinting, and incompatability of the impact intensity levels when the typewriter is changed from a ten to a twelve pitch mode of operation with the corresponding reduction in typeface area.

Uneven print color results from the fact that some characters such as the numeral one and lower case "l" have considerably less surface area than the surface area of other lower case characters such as the lower case m and the capital letters, particularly the large capital letters such as capital M and capital W. The color of the character printed will to some extent be a result of the amount of impact force and embossing which occurs at printing. The smaller characters, i.e. l, i, will tend to penetrate the paper deeper and there will be a broader stroke to that character than a similar width line in a larger area character such as M and W.

Printing noises generated by the impact of the type element against the print page and platen will, with very limited selection of impact levels, such as 2, result in a substantially higher impact level and noise level than that actually required for quality printing in lower case typing.

The use of multiple interchangeable print elements on single element typewriters provide for multiple language capability from a single typewriter. With the substitution of a foreign language head or element onto the typewriter, the pecularities of the alphabetic and graphic characters on that head will result, in some cases, in a very small area symbol such as the umlaut and grave being printed with high velocity and resulting in a high degree of embossing as well as excessive machine noise.

In some cases, typewriters have been provided with a manual intensity level control whereby the operator may override the print velocity mechanism in such a way as to provide an altered print velocity. Even though this manual means exists on typewriters, indications are that a high percentage of the time, the device is not utilized and, therefore, is of no substantial benefit to the user.

The prior art has attempted to minimize or overcome some of these shortcomings by several different methods. The technique of having two separate print intensities is accomplished in two ways in the prior art devices. One is illustrated in U.S. Pat. No. 3,239,049 to W. F. Voit, Jr., and illustrates the technique found in the IBM Selectric Typewriter referred to above. This technique utilizes keyboard coding to shift, through a mechanical connection, a member which, in turn, acts to shift the cam follower from a high velocity lobe to a low velocity lobe on the print cam or vice versa. This device is dependent upon keyboard coding and, therefore, exhibits some of the problems which are described above and, to some extent, limits the choices of foreign language print elements if compatability of the print face and impact level must be maintained. Otherwise, compromises are required to accommodate the keyboard coded impact levels dictated by the mechanical hardware.

U.S. Pat. No. 3,980,169 shows a impact control where a heavy spring provides the printing force by acting upon a drive member. The drive member is stopped or blocked from completing its otherwise normal flight path by a member which is selectively inserted into its path, thereby prematurely terminating the powered portion of the movement of said member, thereby imparting a smaller energy level to the rocker carrying the element.

Other techniques involve the position of the type element controlling the length to which a spring is stretched. The spring then provides a force for printing.

OBJECTS OF THE INVENTION

The primary object of this invention is to economically and reliably increase the number of potential print velocity levels available in a single element printer to provide substantially uniform print quality regardless of print font face area.

Another object of this invention is to provide extensive and enhanced foreign language type element interchangeability without the addition of mechanism for altering print velocities.

A further object of this invention is to eliminate the need for mechanically coding keyboard mechanisms and the necessity for altering such coding upon the shifting from lower to upper case.

A still further object of this invention is to significantly reduce typing noise where high impact force is not necessary.

A still another object of this invention is to improve the uniformity of the print quality and color balance of the printed character of a single element typewriter.

A still additional object of this invention is to reduce character penetration into the printed page and thereby reduce side printing and overprinting.

The foregoing objects are accomplished and the shortcomings of the prior art overcome by the device illustrated in the drawing and described in the detailed description of the invention to follow.

DRAWING

FIG. 6 illustrates a character arrangement on a print head for a German/Austrian language head.

FIGS. 7 and 8 illustrate the varied characters which deviate from those of the German/Austrian head in the Italian and French languages, respectively.

DETAILED DESCRIPTION OF THE INVENTION

To provide the motive force for printing of a character onto the page 9 held in a single element typewriter 6, a print shaft 10 is provided. Print shaft 10 carries thereon a print cam 12. Print cam 12 is driven by print shaft 10.

Figure 2:
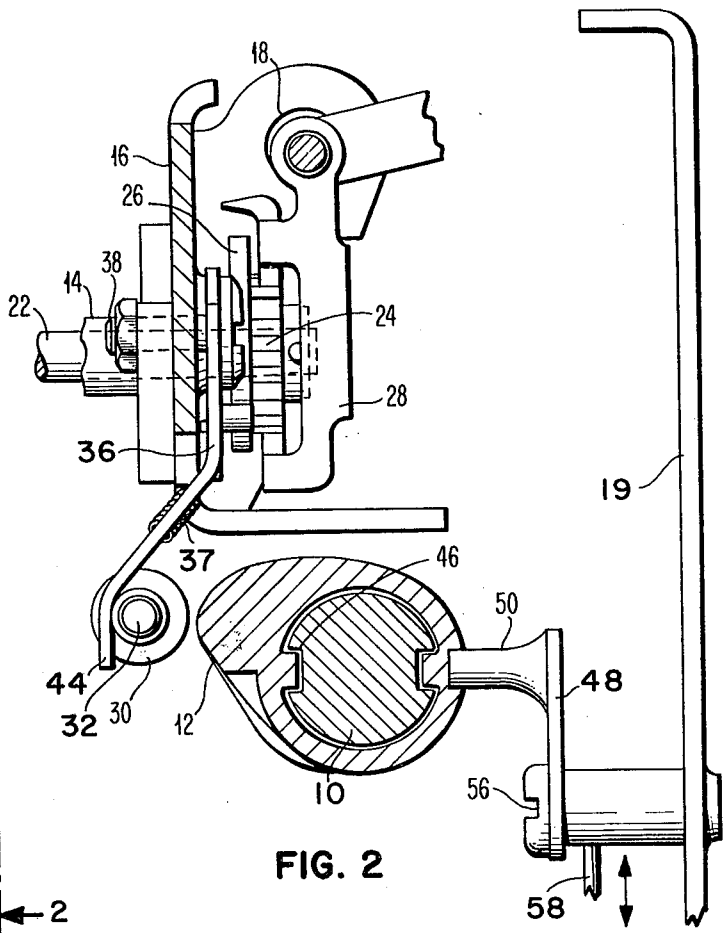
FIG. 2 is a sectional view of the print rocker along lines 2—2 in FIG. 1.
Figure 3:
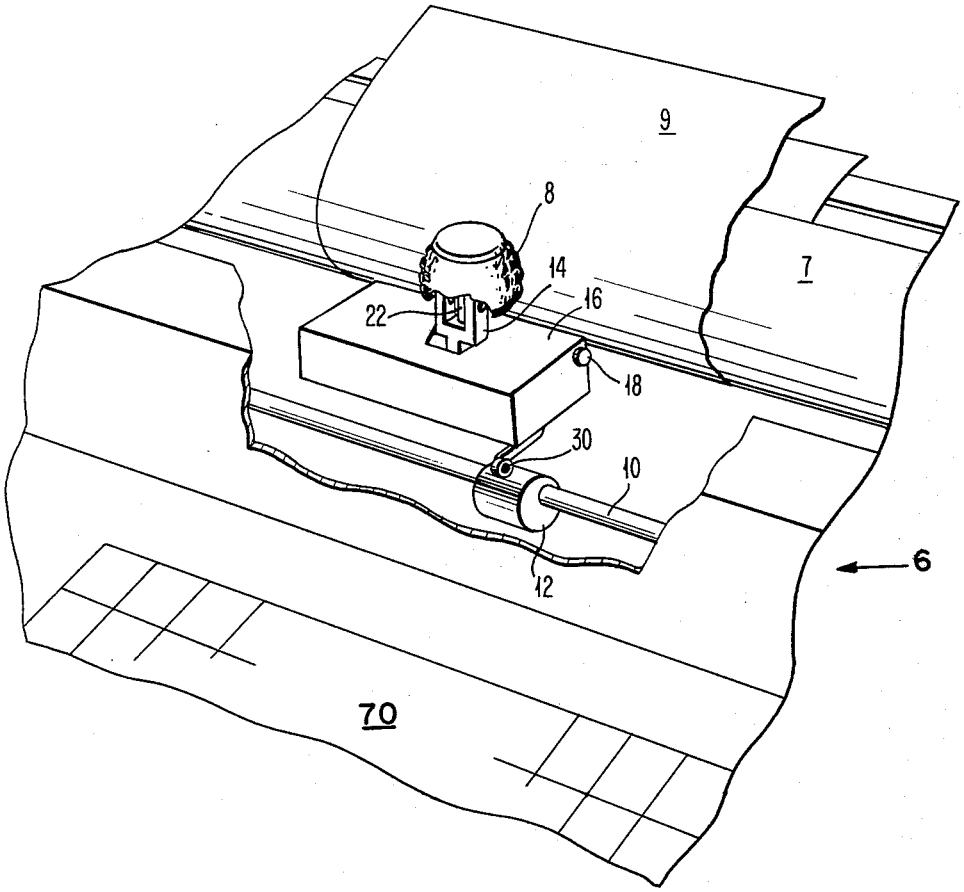
FIG. 3 illustrates a partial view of a single element print mechanism with the platen and copy sheet.

To support the type element 8 for impact against the typewriter platen 7, a yoke support 14 in FIG. 2 is mounted onto the top of rocker 16. Rocker 16 is pivotally supported at pivots 18 on support member 20. In this configuration, rocker 16 pivoting about pivot 18 may oscillate in a clockwise direction in FIG. 2 to cause the impact of the type element 8, supported on yoke support 14 and shown in FIG. 3, against the record page 9. The type element 8 is capable of rotation through the rotation of the shaft 22. Shaft 22 is keyed to selection gear 24 and cam 26. Gear 24 and cam 26 may be separately manufactured or the cam 26 may be formed as a single piece along with the gear 24 as desired. The rotate gear 24 is meshed with one set of teeth on a bifurcated rack 28 which, by movement with respect to gear 24, causes a rotation of gear 24 to effect the selection of a particular column of characters on the type element 8. The detailed operation of the bifurcated rack 28 and its rotation of the type element 8 by rotation of gear 24 may be more clearly understood by referring to pending patent application, Ser. No. 25,824 in the name of John O. Schaefer, filed Apr. 2, 1979, entitled "Variable Pitch Cam Selection System for Single Element Typewriter", now U.S. Pat. No. 4,297,041 issued Oct. 27, 1981.

An alternative selection system also using a shifting rack for a fixed print rocker is illustrated in DeKler, U.S. Pat. No. 3,983,984. Both of the foregoing documents are commonly assigned with this application.

Motion could equally well be transmitted to the moving carrier and selection accomplished in the moving carrier such as that shown in Shakib, U.S. Pat. No. 3,892,304 also commonly assigned with this application.

Figure 1:
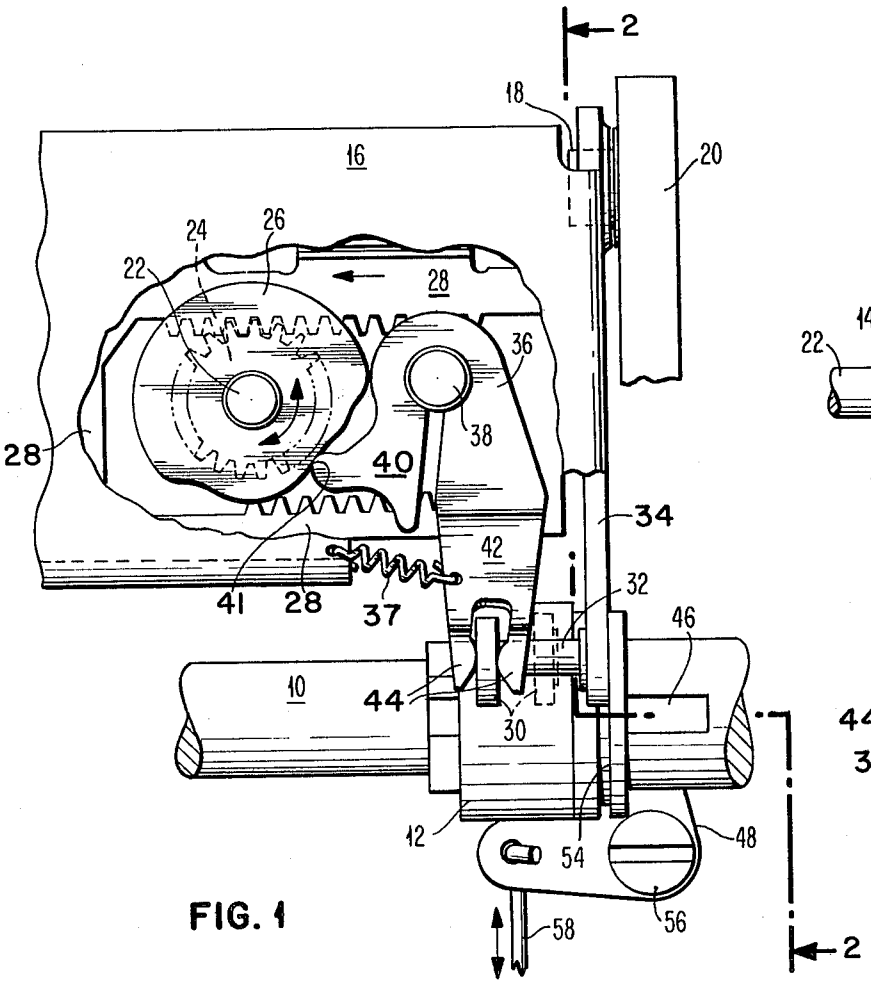
FIG. 1 is a top view of the print rocker of a single element typewriter stripped of non-essential elements of this invention and broken away to reveal the velocity control mechanism mounted thereon.

To derive motion from the rotation of print shaft 10 and print cam 12, cam follower 30 is rotationally mounted on projecting stud 32 in FIG. 1. The rotation of cam 12 will cause cam follower 30 to move outward from the axis of print shaft 10 thus forcing stud 32 outward and thereby causing arm 34 of print rocker 16 to pivot rocker 16 about pivot point 18. Due to the sharp rise of the print cam 12 and the rapid rotation thereof, follower 30 will be allowed to fly away from cam 12 and the rocker 16 will go through what is referred to as free flight until the type element 8 strikes the page 9.

To shift the print cam follower 30 axially along the surface of print cam 12, and on support stud 32, follower 36 is pivotally mounted at support screw 38 on rocker 16. Follower 36 comprises two operative arms, arm 40 which is formed into a follower surface 41 for engagement with impact velocity control cam 26, and arm 42 which terminates in a bifurcated finger arrangement with bifurcated end 44 constraining print cam follower 30 therebetween. Print cam follower 30 as can be seen in FIG. 1 is thereby shiftable along the axis of support stud 32 by a rise in cam 26. As cam 26 rotates to present a desired column of characters on the type element 8 to the print point, cam 26 will present a different rise to the follower surface 41 of cam follower 36. As a higher rise is encountered on cam 26 by follower surface 41, the bifurcated end 44 of follower arm 42 will cause the shift of print cam follower 30 toward the right in FIG. 1. Conversely, as the type element 8 and selection gear 24 and cam 26 restore to the home position, the follower 36 will rotate in a clockwise direction about pivot bolt 38 under the influence of spring 37, thus restoring print cam follower 30 leftward to its lower impact level position. As one can see from this drawing, the control of the impact level may be accomplished by the selection of the plane on print cam 12 which will define a particular cam rise for cam follower 30 to follow. Once the desired plane and thus this impact level is defined, the rise of the cam 12 can then be determined taking into consideration, of course, the overall geometry of the cam follower 36 and the positioning of the pivot bolt 38 thereof on any particular typewriter.

In typewriters having the capability of printing in more than one pitch, it is desireable to shift the mean impact level and thus shift all impact levels or impact intensities in accordance with the approximate change in the area of the type face being printed. Thus, in a shift from a ten pitch typing operation to a twelve pitch typing operation, the area of the characters will be diminished inasmuch as the overall characters are smaller and the impact levels should be, to some extent, reduced accordingly. To accomplish this shift of the print levels, it is possible to shift print cam 12 along the key 46 in the print shaft 10. By shifting cam 12, the net effect is an adjustment of all the print impact intensity levels by an approximately identical amount. This shifting may be accomplished by bellcrank 48 having a tab 50, more clearly shown in FIG. 2, engaging a channel 54 in print cam 12. The movement of bellcrank 48 about its pivot mounting screw 56 will translate the print cam 12 in response to the movement of pitch change link 58. Mounting screw 56 is mounted on frame 19. Pitch change link 58 is controllable from the keyboard 70 through bellcrank 60, link 62 and pitch change lever 64 mounted on frame 19 as illustrated in FIG. 6. Also shown is a boden cable 66 extending from pitch change lever 64 which, in turn, controls the pitch change mechanism not shown since the pitch change mechanism forms no part of the claimed invention.

Figures 4, 5:
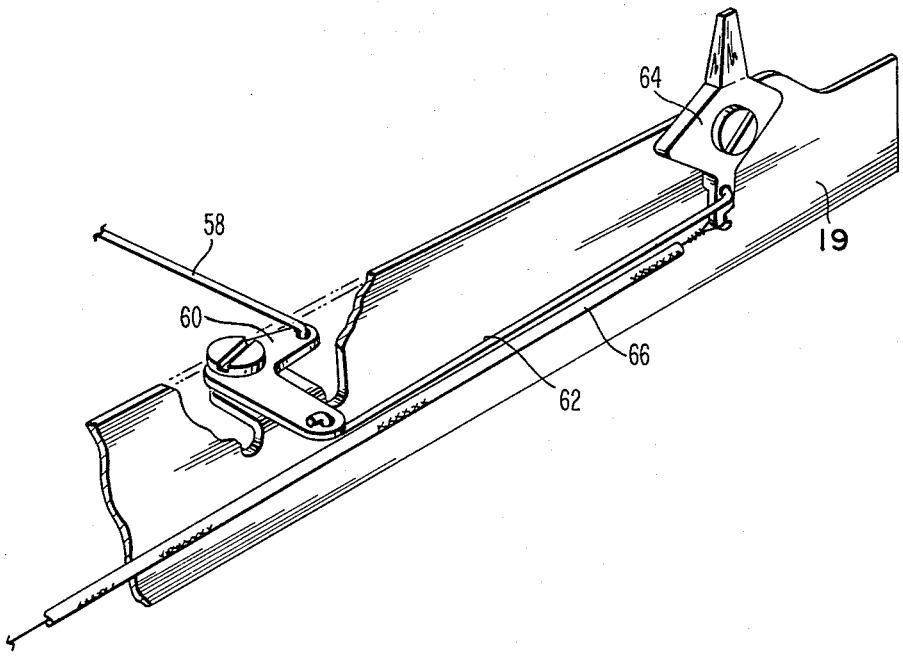
FIG. 4 illustrates a pitch selection apparatus with a connection to the velocity control mechanism for altering the velocities with which print impact occurs to correlate with the approximate print face area.
FIG. 5 illustrates an exemplary character arrangement on the print element.

The characters on the type element 8 may be schematically represented in their arrangement by referring to FIG. 5. FIG. 5 shows the twelve columns of characters in the upper case and lower case segments such that the home position of the typewriter corresponds approximately to the "imaginary plane" dividing the two case fields. The numbers across the top of the matrix are approximate pounds of impact force required for adequate printing. With respect to other typewriters and other type font sizes, it is expected that other typewriters would require a different impact schedule. The figures are only exemplary. As can be seen, if the impact schedule is designed substantially as indicated on the top of FIG. 5, the placement of the characters within this matrix then results in a considerably smaller degree of compromise than that required if there are only two impact levels available.

Clearly with respect to the placement of alphabetic characters, the two halves, upper and lower case, should and must be of essentially mirror images with respect to location to insure proper selection of the character regardless of case, dependent upon a consistent mechanical input. An example of the interchangeability of symbols, characters and other graphics on the type element 8 and still utilize the single machine installed cam 26 for controlling the impact intensity, may be had by referring to FIGS. 6, 7, and 8. The German-/Austrian typehead is illustrated in FIG. 6, together with column numbers across the bottom and impact intensity schedule across the top. The center four bands indicate the layout of the type arrangement on the typehead. With relatively few changes in the common characters, this typehead has the same character arrangement as that of the English language type element 8 illustrated in FIG. 5. Now referring to FIGS. 7 and 8, the blanks in the zone outlined by a heavy line are those characters which are common with FIG. 6 in corresponding locations. As can be seen from this, there is a relatively great latitude available to the typehead designer and the typewriter designer once an impact intensity schedule has been arrived at and implemented through the cam 26 in FIG. 1. Only relatively small compromises then remain for the assignment of the non-common characters and graphics.

FIGS. 5 through 8 are only exemplary and are not intended to dictate any particular character arrangement or standard.

Obviously, machine requirements dictated by other parameters of the machine must be accommodated in this overall scheme.

Operation of the Invention

As a character is selected by any one of a number of selection mechanisms such as referred to above, and the type element 8 is rotated together with its mounting shaft 22, the cam 26 rotates therewith. As the rise increases, the cam follower 36, engaging the cam 26 by follower surface 41, will cause the lateral shift of cam follower 30 along the outside of print cam 12 to a predetermined position corresponding to a selected cam profile. That cam profile has been determined in such a way as to impart the desired impact of the type element 8 for the particular characters found in a column of the type element 8 presented at the print point.

As the print cam 12 rotates in response to the rotation of shaft 10 to which it is keyed, the cam follower 30 acting through support stud 32 and arm 34 of rocker 16 will effect an oscillation up the rise of cam 12 and around pivot 18 such that the type element 8 will then impact the record sheet 9 printing the character selected. A discussion of the tilt of the type element 8 has not been included inasmuch as it bears no relevance to the invention and is conventional and is further disclosed in the patents to Shakib and DeKler referred to above.

As can be seen, a judicious selection of impact intensities can result in a virtually tailor made printing mechanism for a particular character and symbol set with significantly less compromise involved with the substitution of characters or the replacement of printheads with alternate character and symbol arrangements.

Specific values included in the impact schedule are characteristic of one design case but would not, of necessity, be characteristic of other design cases but serve only as illustrative examples.

Clearly, the impact intensity of a particular typewriter will depend upon the means and dynamics of the system and the configuration of the rocker 16, cam follower 36, cam rises on the print cam 12, and other significant components, together with the characteristics of that particular machine design. Inasmuch as this information cannot be adequately quantified, it suffices to say that the rises at each incremental rotary position of cam 26 necessary to derive the appropriate impact intensity through the placement of cam follower 30 on print cam 12 must, of necessity, be imperically determined for a particular machine.

The principle of the cam 26, rotating with the type element 8 and thereby controlling through a follower 36 the position of an additional cam follower 30, thereby controlling within the machine parameters, the impact intensity, is clearly a valid design concept regardless of specific impact intensity values and specific cam profiles.

In view of the necessity to design each typewriter as an overall system, it is clear that changes must be made from that disclosed within this disclosure without departing from the scope of the invention as set forth in the claims below.

I claim:

1. A print velocity control apparatus for a typewriter having a single print element, comprising:

means for impacting said single print element against a record sheet with one of a plurality of velocities, and cam means rotationally coupled to and rotatable with said single print element for selecting a velocity of impact of said single print element in accordance with character positions on said single print element.

2. The print velocity control apparatus of claim 1 wherein said cam means rotatable with said single print element for varying the impact of said single print element, further comprises a cam follower means responsive to said cam means for positioning a second follower means for engaging said means for impacting.

3. The print velocity control apparatus of claim 2 wherein said second follower means is shiftable along the surface of said means for impacting to engage varying cam profiles.

4. The print velocity control apparatus of claim 1 wherein said means for impacting said single print element comprises a cyclically operable print cam.

5. The print velocity control apparatus of claim 4 wherein said cyclically operable print cam comprises a plurality of varying cam profiles defined by sections taken perpendicular to the rotational axis of said print cam.

6. The print velocity control apparatus of claim 5 wherein said print cam has a surface and said surface is continuous between the end planes perpendicular to said rotational axis thereof.

7. A print velocity control for a single element typewriter, comprising:

a print element;

a print cam;

a rocker supporting said element;

a print cam follower engaged with said print cam and mounted on said rocker supporting said element;

said print cam follower mounted to transmit motion generated by said print cam and follower to said rocker to effect impact of said element against a record sheet;

said print cam having an axis and a cam surface of varying profiles at different points axially long its surface, and means for selecting one of said varying profiles as a function of rotation of said element, whereby said print cam determines the velocity with which said element will be propelled for printing, depending upon the position of said element.

8. The print velocity control of claim 7 wherein the means for selecting one of said varying profiles comprises a velocity selection cam rotatable with said print element.

9. The print velocity control of claim 8 wherein said means for selecting one of said varying profiles further comprises a velocity selection cam follower means engaged with said velocity selection cam and displaceable thereby, said velocity selection cam follower means further engaged with said print cam follower for shifting said print cam follower.

10. The print velocity control of claim 9 wherein said print cam follower engaged with said print cam is moved by said velocity selection cam follower means parallel to said axis of said print cam.

11. A print velocity control for a single print element typewriter, comprising:

means for generating movement of a print element toward a record sheet with sufficient velocity to impact said sheet for printing;

means for rotating said element to present a column of characters on said print element for printing;

means responsive to said means for rotating said element for controlling said velocity of said element, comprising a first cam and first follower, said cam comprising a plurality of cam rises associated with a plurality of rotational positions of said element, wherein said means for generating a printing movement of said print element comprises a second cam having a cam surface and second follower engageable with said cam surface of said second cam, and said second cam is configured to form a plurality of cam profiles at different positions axially along said cam surface, and said second follower is moveable, along said second cam to select one of said plurality of cam profiles, by said first follower engaged with one of said plurality of cam rises on said first cam, wherein said second follower is moveable in response to said first cam rotatable with said element.

12. A velocity control for controlling the print element velocity with which a print element is propelled for printing, comprising:

a print cam;

a print cam follower, said print cam comprising a rise surface of varying rates at various axial positions along the length of said cam forming a plurality of cam profiles, said rise surface being continuous;

a second cam follower for shifting said print cam follower with respect to said print cam;

a second cam rotatable with said element with a plurality of rises for controlling the movement of said second cam follower, thereby controlling the position of said print cam follower with respect to said print cam and said print cam's plurality of cam profiles, said plurality of rises corresponding to the columnar positions of characters on said element and operative to define the position of said print cam follower relative to said print cam, whereby the appropriate velocity for printing may be determined by element rotation for a selected group of characters.

13. The velocity control of claim 12 wherein said print cam is axially translatable with respect to its axis and in respect to said print cam follower, and means for translating said print cam.

14. The velocity control of claim 13, said means for translating said print cam comprising:

operator controlled selectable means for shifting said print cam axially thereof, whereby all print velocities are altered to accommodate a typefont of different surface area.

15. A velocity control apparatus for a single element typewriter having a rocker, for defining the velocity imparted to said rocker of said typewriter, said typewriter comprising a rockable member supporting a single type element for cam driven impact onto a print page;

said typewriter comprising a cyclically rotatable member operable in response to keyboard actuation, said cyclically rotatable member further comprising a print cam member having an axis and rotatable therewith;

said print cam member comprising a continuous plurality of cam profiles spaced between the ends of said print cam member, said rocker comprising a print cam follower means engageable with said print cam member and supported by said rocker to provide movement derived from one of said cam profiles to said rocker for impacting said type element onto said page, said print cam follower means being shiftable along and parallel to said axis of said print cam member to engage one of said profiles;

said rocker supporting means for rotating said type element in response to keyboard operation to present a keyboard selected character in position for printing, said means for rotating further supporting a cam means, said cam means rotatable with said means for rotating;

said cam means having a plurality of rises around the periphery thereof, said rises being predefined in correlation with the desired velocity with which said type element will impact said page, said rise corresponding to rows of characters on said type element;

said rocker carrying pivotally mounted thereon a follower means for engagmenet with said cam means supported on said means for rotating, and engageable with said print cam follower means to cause said print cam follower means to shift with respect to said print cam member thereby selecting in response to type element rotation, a print cam profile.

16. The velocity control apparatus of claim 15 wherein said cam member is axially displaceable with respect to said cyclically rotatable member for shifting the cam profiles of said cam member with respect to said cam follower means engageable with said cam member, and means for displacing said cam member.

17. The velocity control means of claim 16, said means for displacing said cam member comprising operator selectable means for shifting said print cam member axially with respect to said cyclically rotatable member and with respect to said print cam follower means to alter the mean velocities generated by said cyclically rotatable member and said print cam follower means.

18. A print velocity control for a single element typewriter, comprising:

a print element;

a print cam;

a rocker supporting said element;

a print cam follower engaged with said print cam and mounted on said rocker supporting said element;

said print cam follower mounted to transmit motion generated by said print cam and follower to said rocker to effect impact of said element against a record sheet;

said print cam having an axis and a cam surface of varying profiles at different points axially along its surface, and means for selecting one of said varying profiles as a function of rotation of said element, whereby said print cam determines the velocity with which said element will be propelled for printing, depending upon the position of said element, and means for altering the mean impact levels generated by said cam to accommodate a change in typefont area with respect to the entire character set.

19. The print velocity control of claim 18 wherein said means for altering further comprises selectable means for axially shifting said print cam along its axis with respect to said follower engaged with said print cam.

20. The print velocity control of claim 19 wherein said selectable means is operator controllable.

21. A print velocity control for a single print element typewriter, comprising:

means for generating movement of a print element toward a record sheet with sufficient velocity to impact said sheet for printing;

means for rotating said print element to present a column of characters on said print element for printing;

means responsive to said means for rotating said element for controlling said velocity of said element, comprising a first cam and first follower, said cam comprising a plurality of profiles corresponding to velocities of said print element required for printing characters of said columns, said first cam rotatable in the same direction and same angular displacement as said element, wherein said means for generating a printing movement of said print element comprises a second cam having a cam surface and second follower engageable with said cam surface of said second cam, and said second cam is configured to form a plurality of cam profiles at different positions axially along said cam surface, and said cam surface of said second cam defining the rise thereof is continuous between the two ends thereof, said second follower is moveable, along said second cam to select one of said plurality of cam profiles, by said first follower, wherein said second follower is moveable in response to said first cam rotatable with said element.

22. A print velocity control for a single print element typewriter, comprising:

means for generating movement of a print element toward a record sheet with sufficient velocity to impact said sheet for printing;

means for rotating said element to present a column of characters on said print element for printing;

means responsive to said means for rotating said element for controlling said velocity of said element, comprising a first cam and first follower, wherein said means for generating a printing movement of said print element comprises a second cam having a cam surface and second follower engageable with said cam surface of said second cam, and said second cam is configured to form a plurality of cam profiles at different positions axially along said cam surface, and said second cam is shiftable axially with respect to the remainder of said mechanism and particularly said second follower, means for shifting said second cam axially, said second follower is moveable, along said second cam to select one of said plurality of cam profiles, by said first follower, wherein said second follower is moveable in response to said first cam rotatable with said element.

23. A print velocity control for a single print element typewriter, comprising:

means for generating movement of a print element toward a record sheet with sufficient velocity to impact said sheet for printing;

means for rotating said element to present a column of characters on said print element for printing;

means responsive to said means for rotating said element for controlling said velocity of said element, comprising a first cam and first follower, wherein said means for generating a printing movement of said print element comprises a second cam having a cam surface and second follower engageable with said cam surface of said second cam, and said second cam is configured to form a plurality of cam profiles at different positions axially along said cam surface, and said second follower is moveable, along said second cam to select one of said plurality of cam profiles, by said first follower, wherein said second follower is moveable in response to said first cam rotatable with said element and means for shifting said second cam axially with respect to said second follower, whereby said velocity of said single print element may be altered with respect to all rotational positions of said print element to accommodate a typefont with a different area.

* * * * *